US006880204B2

(12) United States Patent
Ochiai

(10) Patent No.: US 6,880,204 B2
(45) Date of Patent: Apr. 19, 2005

(54) CHECKER-EQUIPPED DOOR HINGE

(75) Inventor: Manabu Ochiai, Sakado (JP)

(73) Assignee: Rikenkaki Kogyo Kabushiki Kaisha, Saitama (JP)

( * ) Notice: Subject to any disclaimer, the term of this patent is extended or adjusted under 35 U.S.C. 154(b) by 0 days.

(21) Appl. No.: 10/455,821

(22) Filed: Jun. 6, 2003

(65) Prior Publication Data

US 2004/0244141 A1 Dec. 9, 2004

(51) Int. Cl.[7] ..... E05F 5/02; E05D 11/10

(52) U.S. Cl. ..... 16/82; 16/85; 16/334; 16/335; 16/327

(58) Field of Search ..... 16/335, 334, 308, 16/332, 327, 821, 85; 296/146.4, 146.12

(56) References Cited

U.S. PATENT DOCUMENTS

| | | | | | |
|---|---|---|---|---|---|
| 2,992,452 | A | * | 7/1961 | Schonitzer | 16/309 |
| 3,550,185 | A | * | 12/1970 | Marchione | 16/297 |
| 3,889,316 | A | * | 6/1975 | Koike | 16/297 |
| 4,285,098 | A | * | 8/1981 | Hicks et al. | 16/308 |
| 4,677,708 | A | * | 7/1987 | Streett | 16/334 |
| 4,720,895 | A | * | 1/1988 | Peebles | 16/264 |
| 4,794,669 | A | * | 1/1989 | Sanders | 16/341 |
| 4,815,164 | A | * | 3/1989 | Rottinghaus | 16/296 |
| 5,067,201 | A | * | 11/1991 | Marchione | 16/270 |
| 5,850,673 | A | * | 12/1998 | Wood et al. | 16/334 |
| 5,926,917 | A | * | 7/1999 | Gantz | 16/334 |

FOREIGN PATENT DOCUMENTS

| | | | | |
|---|---|---|---|---|
| DE | 2420295 | A * | 11/1975 | B60J/5/00 |
| DE | 3125966 | A1 * | 1/1983 | E05D/11/06 |
| DE | 3223938 | A1 * | 12/1983 | E05D/15/02 |
| JP | 2001-295535 | | 10/2001 | |

* cited by examiner

*Primary Examiner*—Chuck Y. Mah
(74) *Attorney, Agent, or Firm*—Arent Fox PLLC

(57) ABSTRACT

A checker-equipped door hinge is provided in which a first notch and a second notch are respectively provided on the front surface and the reverse surface of a fixed base of a second hinge arm, and a torsion spring is formed from a single length of spring wire rod so as to have a torsion shaft portion supported in the first notch, a fixed end portion supported in the second notch, a free end portion rotatably supporting a roller, a U-shaped fixed arm portion providing a connection between the fixed end portion and one end of the torsion shaft portion, and a U-shaped movable arm portion providing a connection between the other end of the torsion shaft portion and the free end portion. This provides a checker-equipped door hinge that has a simple structure for mounting the torsion spring in the second hinge arm, together with good ease of mounting.

2 Claims, 7 Drawing Sheets

CHECKER-EQUIPPED DOOR HINGE

BACKGROUND OF THE INVENTION

1. Field of the Invention

The present invention relates to a checker-equipped door hinge used in an automobile, etc. and in particular to an improvement in a checker-equipped door hinge that includes a first hinge arm fixedly attached to one of a body and a door, a second hinge arm fixedly attached to the other one of the body and the door, a hinge pin connecting the first and second hinge arms in a relatively pivotable manner, and a checker that includes a check cam that has a plurality of detent notches and is provided on the first hinge arm, a roller that can sequentially engage with the plurality of detent notches in response to the pivoting of the first and second hinge arms relative to each other, and a check spring that is mounted in the second hinge arm and biases the roller in a direction in which the roller engages with the detent notches.

2. Description of the Related Art

Such a checker-equipped door hinge is already known from, for example, Japanese Patent Application Laid-open. No. 2001-295535.

In the conventional checker-equipped door hinge, a structure for mounting a torsion spring in a second hinge arm is complicated and, in particular, since it is necessary to bore a plurality of through holes in the second hinge arm for the torsion spring to be inserted through, the machining therefor is troublesome and, moreover, the ease of mounting the torsion spring cannot be said to be good.

SUMMARY OF THE INVENTION

The present invention has been achieved in view of such circumstances, and it is an object of the present invention to provide a checker-equipped door hinge that has a simple structure for mounting the torsion spring in the second hinge arm, together with good ease of mounting.

In order to accomplish this object, a first aspect of the present invention provides a checker-equipped door hinge that includes a first hinge arm fixedly attached to one of a body and a door, a second hinge arm fixedly attached to the other one of the body and the door, a hinge pin connecting the first and second hinge arms in a relatively pivotable manner, and a checker that includes a check cam that has a plurality of detent notches and is provided on the first hinge arm, a roller that can sequentially engage with the plurality of detent notches in response to the pivoting of the first and second hinge arms relative to each other, and a check spring that is mounted in the second hinge arm and biases the roller in a direction in which the roller engages with the detent notches, wherein the second hinge arm has a first notch provided on the front surface of a fixed base fixedly attached to said other one of the body and the door, the first notch being parallel to the hinge pin, and has a second notch provided on the reverse surface of the fixed base at a position spaced from the first notch toward the side opposite to the hinge pin, a check spring is formed from a single length of spring wire rod so as to have a torsion shaft portion supported in the first notch, a fixed end portion supported in the second notch, a free end portion rotatably supporting the roller, a U-shaped fixed arm portion providing a connection between the fixed end portion and one end of the torsion shaft portion, and a U-shaped movable arm portion providing a connection between the other end of the torsion shaft portion and the free end portion, and a set loading is applied to the torsion shaft portion in a twisting direction such that the free end portion is biased toward the detent notch side.

In accordance with this first aspect, the torsion spring can be mounted in the second hinge arm by a remarkably simple structure in which the first and second notches are provided on the front and reverse surfaces of the fixed base of the second hinge arm, the torsion shaft portion and the fixed end portion of the torsion spring are engaged with these notches, and a set loading is applied to the torsion shaft portion in a twisting direction. In particular, it is remarkably easy to machine the front and reverse surfaces of the fixed base of the second hinge arm to form the first and second notches and to engage the torsion shaft portion and the fixed end portion with the first and second notches, thus improving the workability and the assemblability and contributing to a reduction in cost.

Furthermore, in accordance with a second aspect of the present invention, in addition to the first aspect, there is proposed a checker-equipped door hinge wherein the opening of the second notch is blocked by said other one of the body and the door to which the fixed base is fixedly attached.

In accordance with this second aspect, the opening of the second notch can be blocked, without using any special blocking member, to prevent the fixed end portion from falling out of the second notch, thereby contributing to a further simplification of the structure.

The above-mentioned object, other objects, characteristics, and advantages of the present invention will become apparent from an explanation of a preferred embodiment that will be described in detail below by reference to the attached drawings.

DESCRIPTION OF THE PREFERRED EMBODIMENT

A preferred embodiment of the present invention is explained below by reference to the attached drawings.

Figure 1:
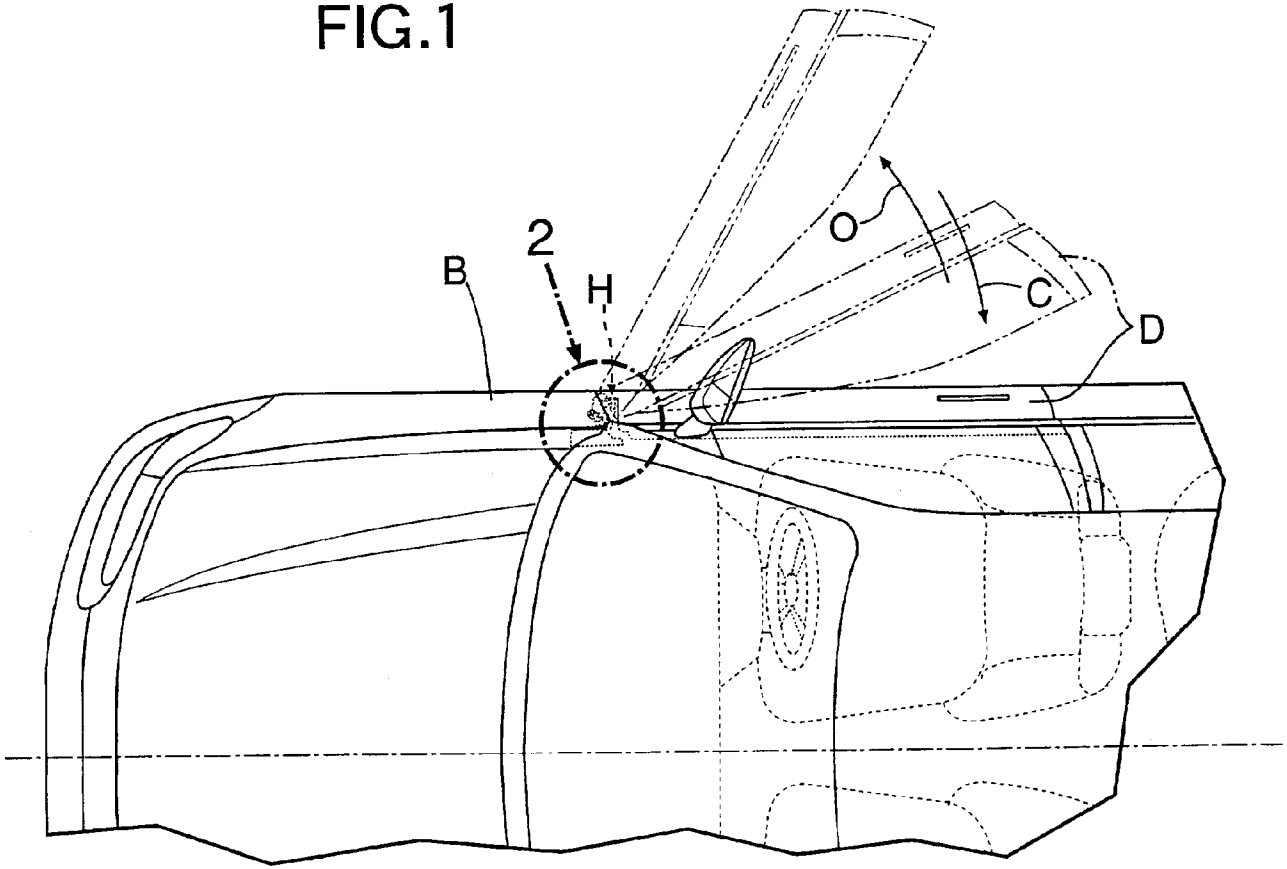
FIG. 1 is a plan view of an automobile having a checker-equipped door hinge of the present invention.
Figure 2:
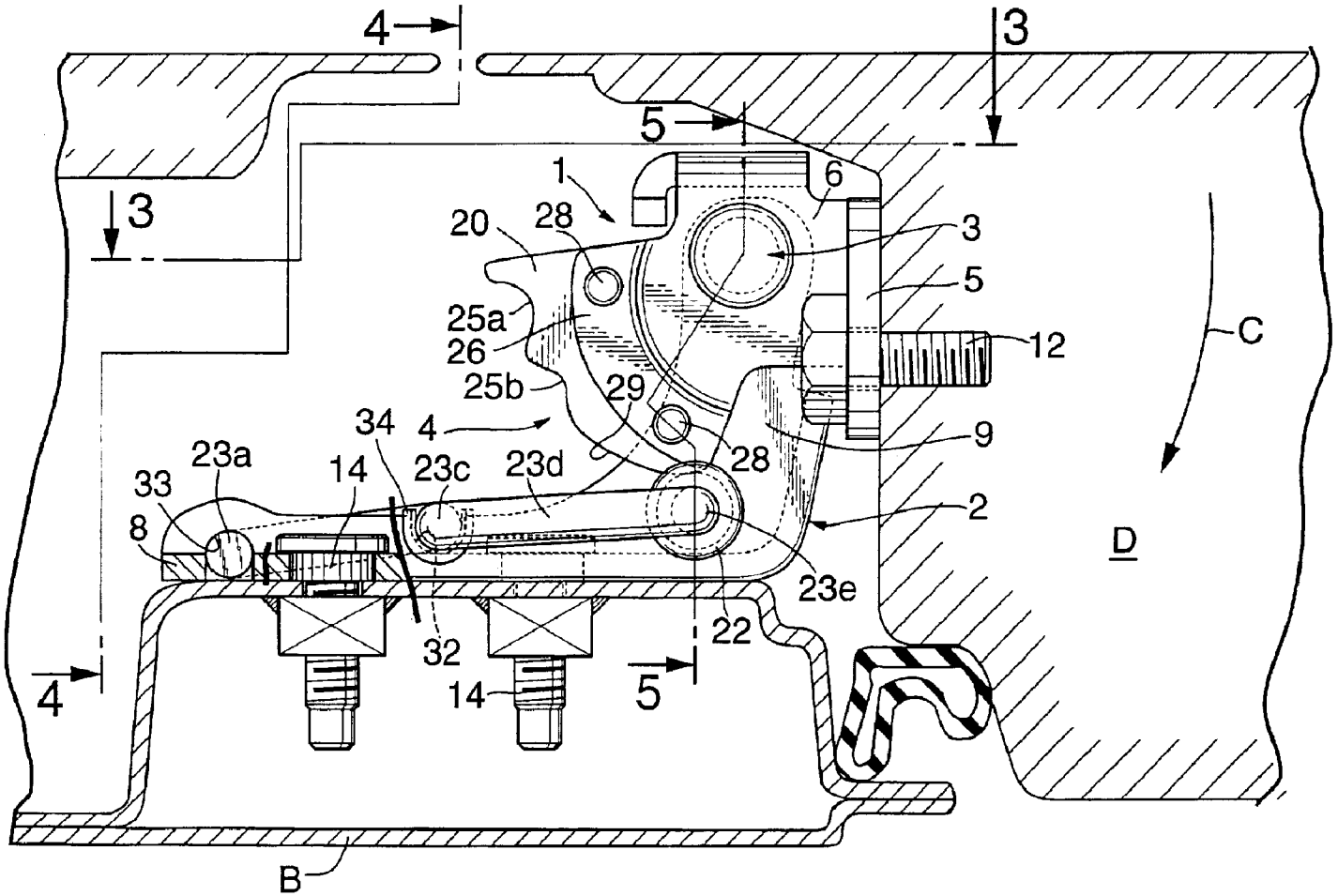
FIG. 2 is an enlarged plan view of part 2 in FIG. 1.
Figure 3:
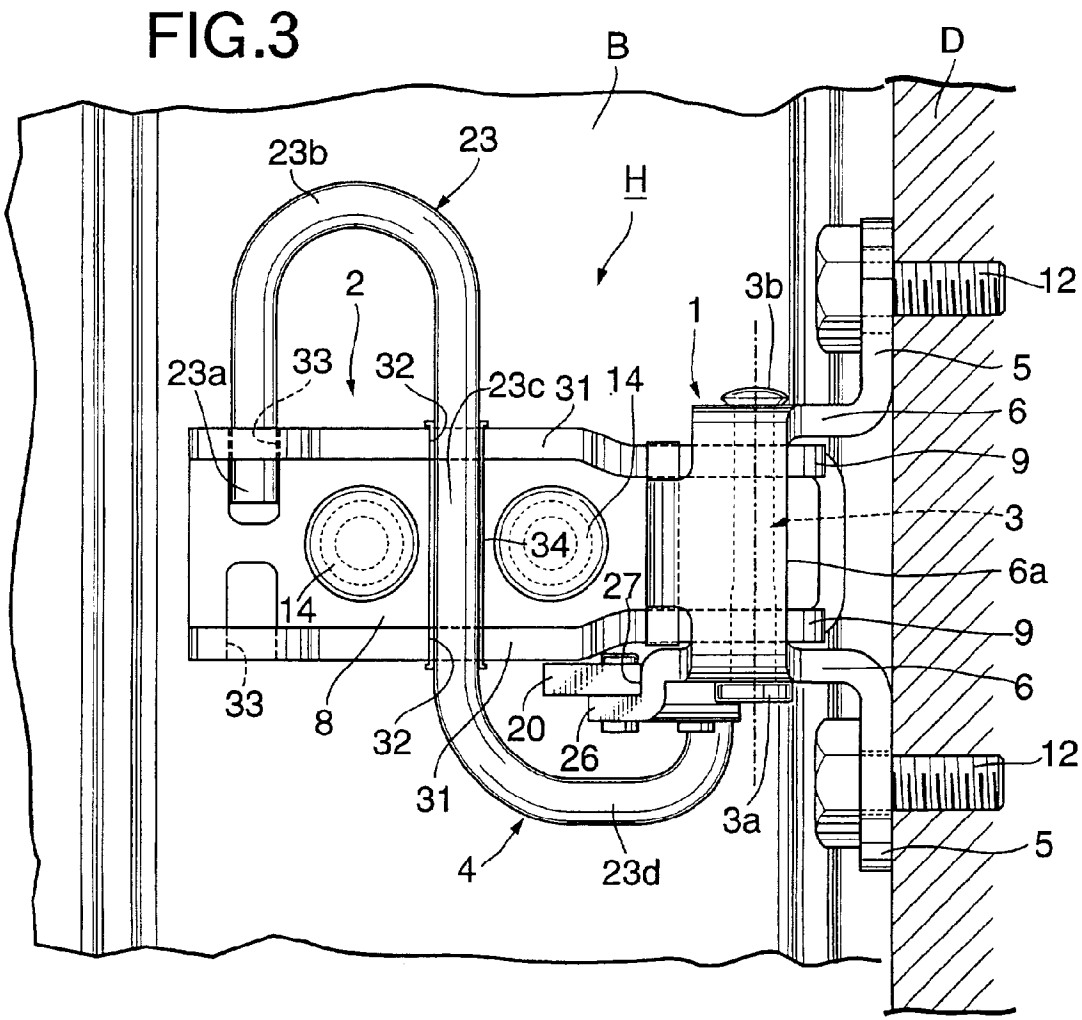
FIG. 3 is a view from arrows 3—3 in FIG. 2.
Figure 4:
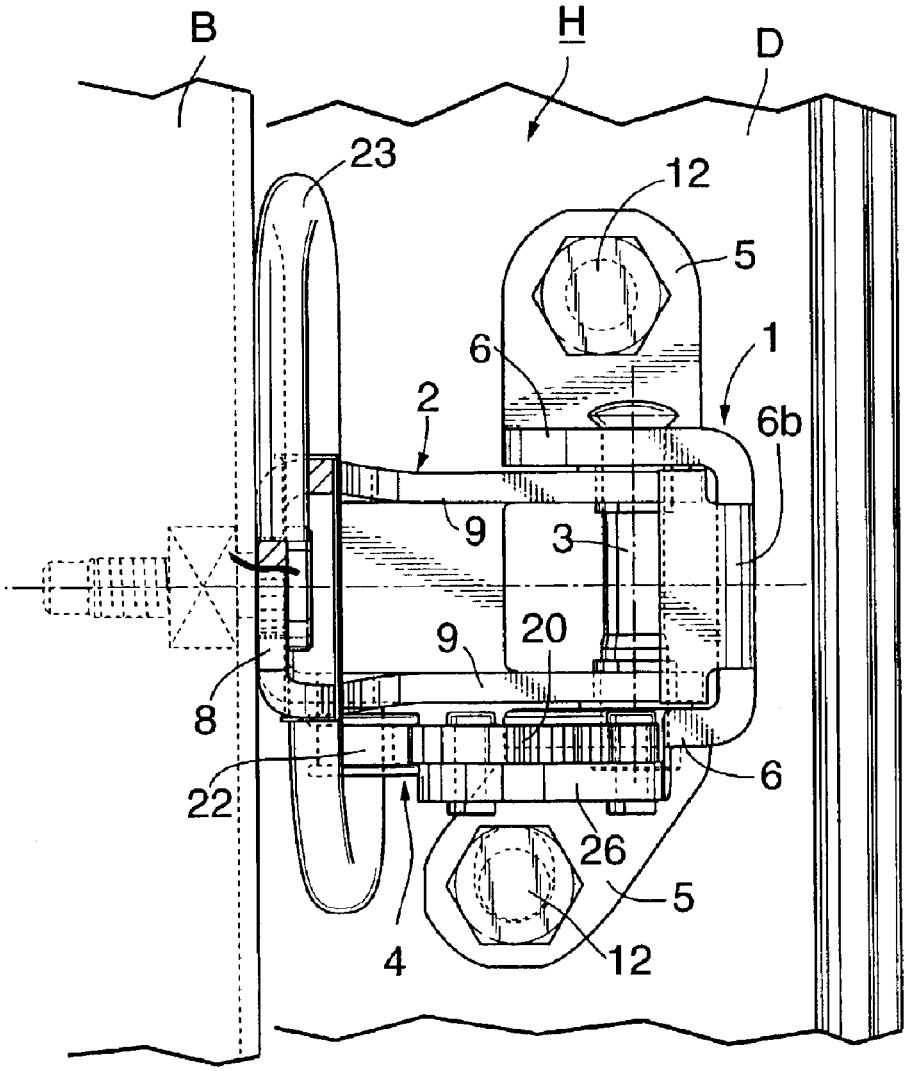
FIG. 4 is a view from arrows 4—4 in FIG. 2.
Figure 5:
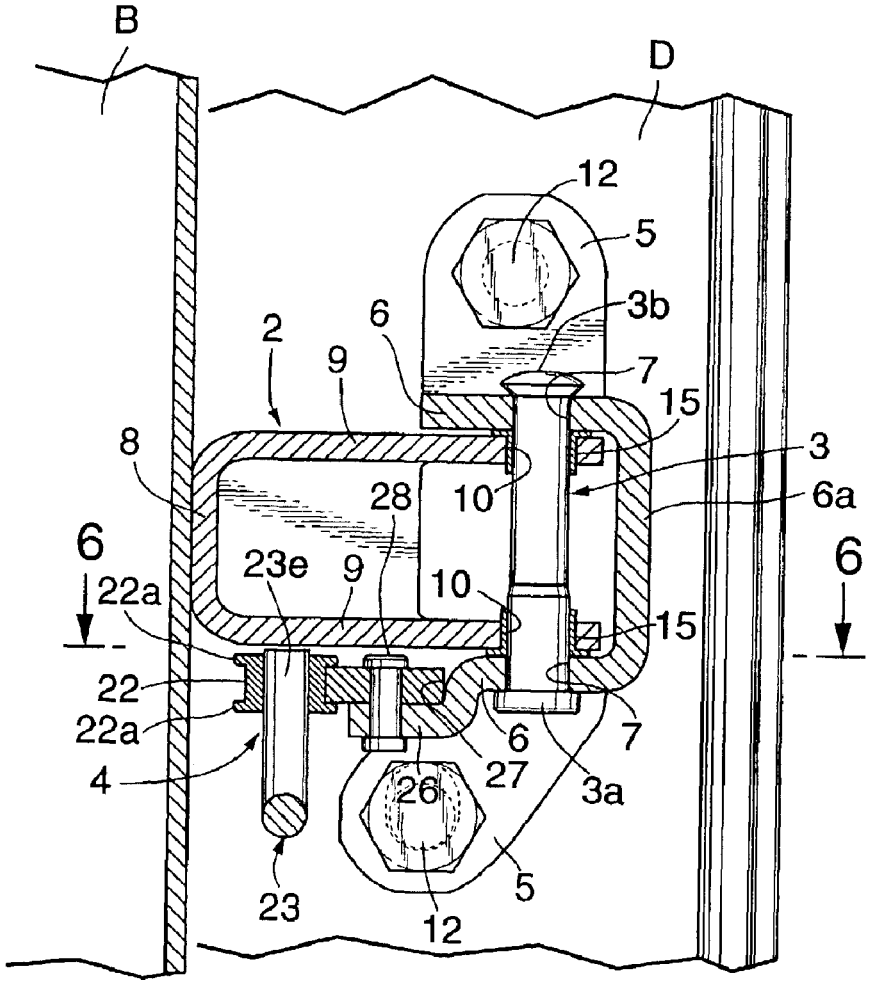
FIG. 5 is a cross section along line 5—5 in FIG. 2.
Figure 6:
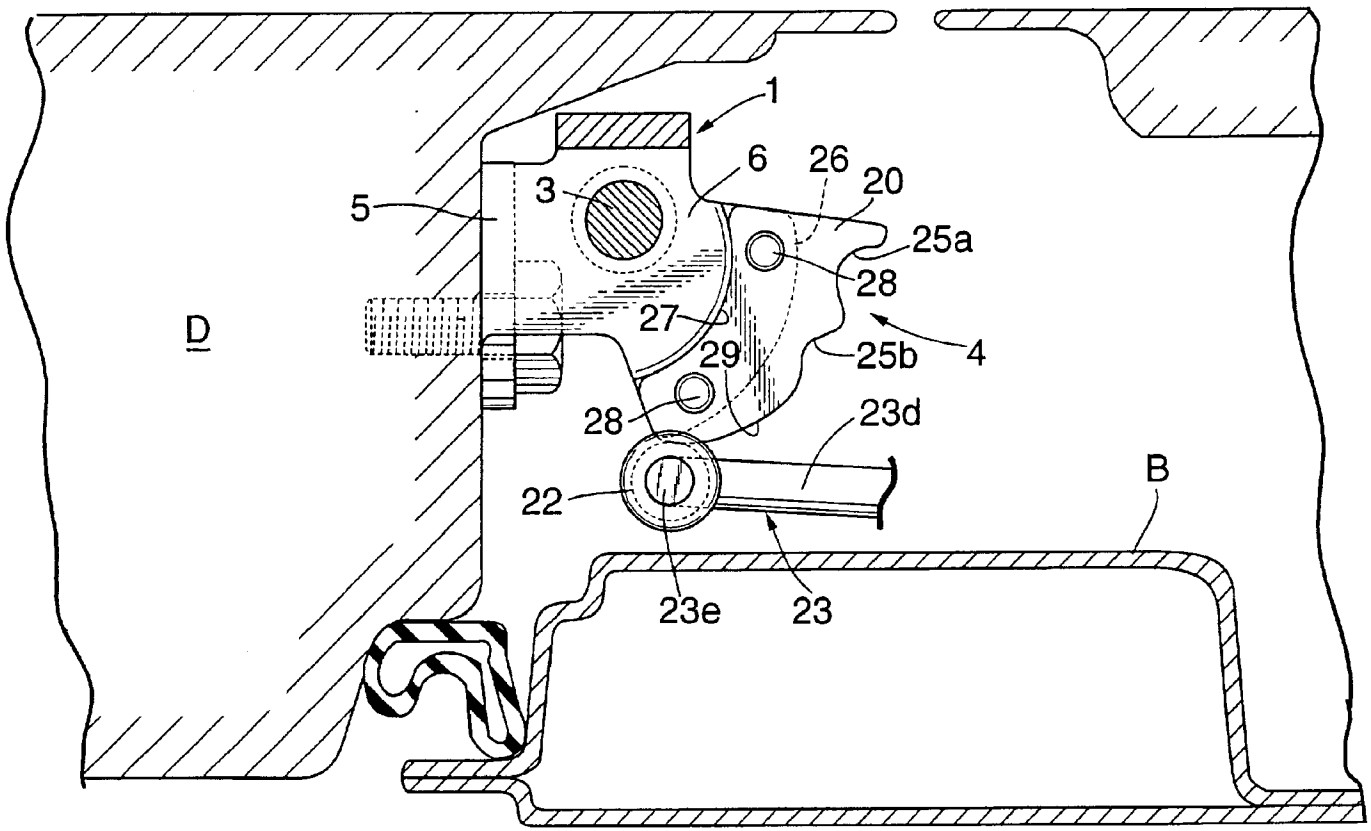
FIG. 6 is a cross section along line 6—6 in FIG. 5.
Figure 7:
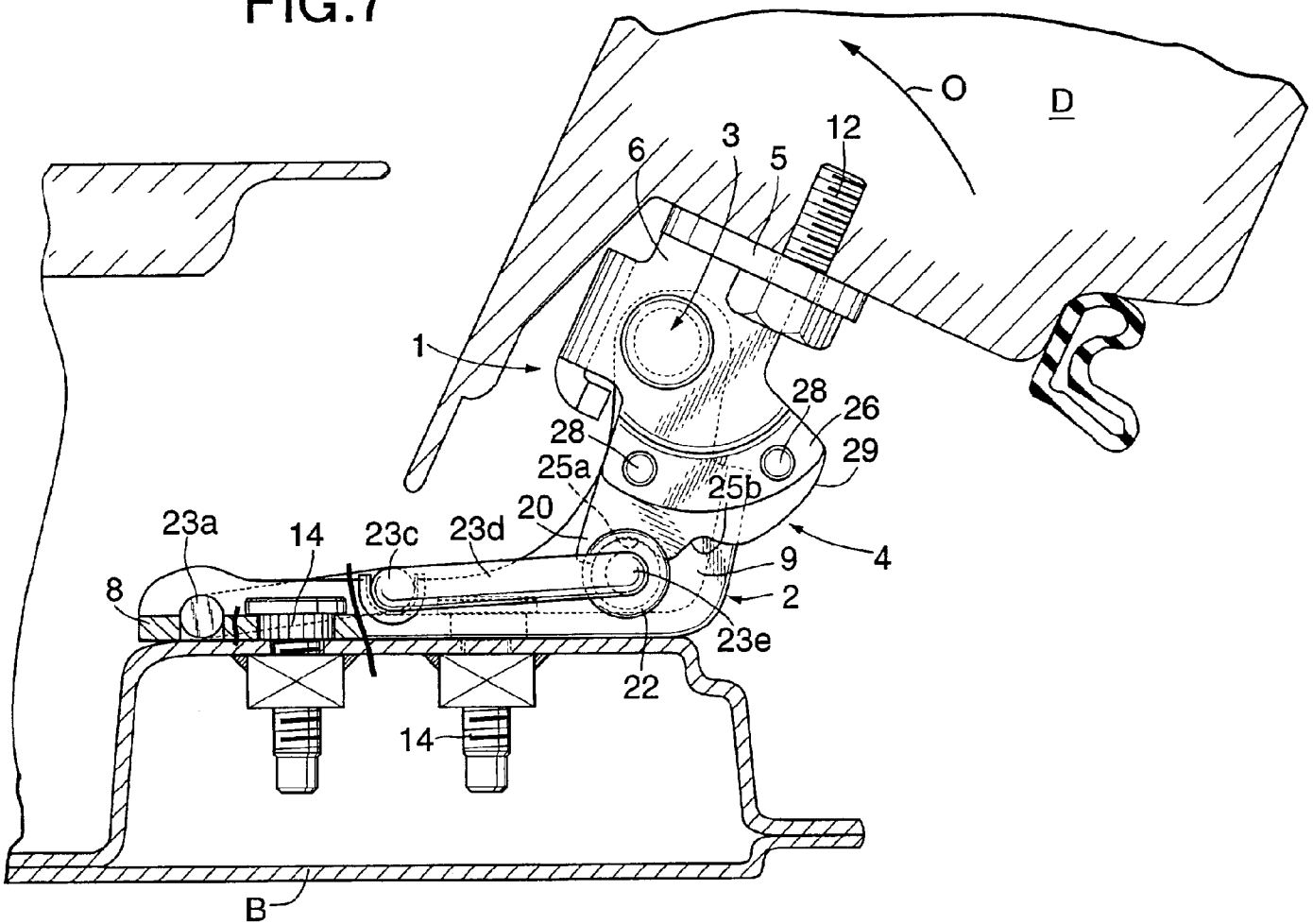
FIG. 7 is a view, corresponding to FIG. 2, showing a state in which a door is fully open.

Firstly, in FIG. 1 to FIG. 3, an automobile body B has a door D for opening and closing an entrance thereof, the door D being attached to the body B via a checker-equipped door hinge H of the present invention. The checker-equipped door hinge H is formed from a first hinge arm 1 fixedly attached to the door D, a second hinge arm 2 fixedly attached to the body B, a hinge pin 3 with an expanded head 3*a* for connecting the two hinge arms 1 and 2 in a relatively pivotable manner, and a checker 4 provided between the two hinge arms 1 and 2 and imparting a stepwise limiting resistance to the pivoting of the two hinge arms 1 and 2 relative to each other.

The first hinge arm 1 is formed from a pair of fixed bases 5, a pair of opposing outer arms 6 rising from opposing edges of the two fixed bases 5, and a connecting part 6*a* integrally connecting together edges on one side of these outer arms 6, the fixed bases 5 being fixedly attached to an end wall of the door D with bolts 12. A pair of coaxially arranged pin holes 7 are bored in the outer ends of the outer arms 6.

The second hinge arm 2 is formed from an oblong fixed base 8 and a pair of opposing inner arms 9 rising from one end part of the fixed base 8, the fixed base 8 being fixedly attached to the body B with bolts 14. The inner arms 9 have pin holes 10 into which bushes 15 are inserted. The bushes 15 are inserted between the outer arms 6 such that these bushes 10 are in line with the pair of pin holes 7. Fitting the hinge pin 3 with the expanded head 3*a* into the pin holes 7 and the bushes 15 connects the first and second hinge arms 1 and 2 in a relatively pivotable manner. An expanded part 3*b* is formed at the tip end of the hinge pin 3 by upsetting to prevent it from dropping out.

In the figures, 'O' denotes the direction in which the door D opens and 'C' denotes the direction in which it closes.

As shown in FIG. 2 to FIG. 6, the checker 4 is formed from a check cam 20 riveted to the first hinge arm 1, a torsion spring 23 attached to the second hinge arm 2, and a roller 22 that is supported on a free end portion of the torsion spring 23 and resiliently engages with the check cam 20.

The check cam 20 is molded, separately from the first hinge arm 1, using a sintered metal, has an overall arced plate shape, and has a plurality of detent notches 25*a* and 25*b* arranged in the peripheral direction on the outer peripheral surface thereof. A mounting flange 26 is provided, via an arc-shaped positioning step 27, integrally with one of the outer arms 6 of the first hinge arm 1 to which the check cam 20 is attached, the mounting flange 26 being spaced from the inner arm 9 adjacent to said one of the outer arms 6. The check cam 20 is superimposed on the mounting flange 26 while engaging the inner peripheral surface of the check cam 20 with the positioning step 27, and fixedly attached to the mounting flange 26 with a plurality of rivets 28.

The outer peripheral surface of the check cam 20 projects outward in the radial direction from the outer peripheral surface of the mounting flange 26, and a plurality of detent notches 25*a* and 25*b* are arranged thereon in the peripheral direction. In the illustrated example, the two detent notches 25*a* and 25*b* are disposed in two locations on the outer peripheral surface of the check cam 20; in an outer end position close to the outside of the door D, and in a middle position. A section of the outer peripheral surface of the check cam 20 between the middle detent notch 25*b* and an inner end part close to the inside of the door D is formed into an angled surface 29 approaching the hinge pin 3 side in the direction to the inner end part.

Formed integrally on upper and lower edges of the oblong fixed base 8 of the second hinge arm 2 are a pair of ribs 31 projecting from the surface of the fixed base 8 and connected to the two inner arms 9. A semicylindrical bush 34 is fitted into a pair of first semicircular notches 32 provided in middle sections of the ribs 31. A pair of second semicircular notches 33 are provided on the reverse side (surface on the body B side) of an end part of the fixed base 8 on the side opposite to the inner arms 9, the second notches 33 being arranged parallel to the first notches 32. Openings of these second notches 33 are blocked by a mounting surface of the body B, to which the fixed base 8 is fixedly attached.

The torsion spring 23 is formed from a single length of spring wire rod and has a fixed end portion 23*a* supported in one of the second notches 33, a torsion shaft portion 23*c* supported in the first notches 32 via the bush 34, a free end portion 23*e* disposed so as to face the outer peripheral surface of the check cam 20, a U-shaped fixed arm portion 23*b* providing a connection between the fixed end portion 23*a* and one end of the torsion shaft portion 23*c*, and a U-shaped movable arm portion 23*d* providing a connection between the other end of the torsion shaft portion 23*c* and the free end portion 23*e*. Rotatably fitted around the free end portion 23*e* is a synthetic resin-molded roller 22 that can roll on the outer peripheral surface of the check cam 20.

A set loading is given to the torsion shaft portion 23*c* in a twisting direction to bias the free end portion 23*e* toward the outer peripheral surface of the check cam 20. That is, when the torsion spring 23 is in a free state, and the fixed end portion 23*a* and the torsion shaft portion 23*c* are supported on one of the second notches 33 and the bush 34, the movable arm portion 23*d* is raised from the fixed base 8 as shown by a broken line in FIG. 2. In order to bring the roller 22 of the free end portion 23*e* into contact with the outer peripheral surface of the check cam 20, if the movable arm portion 23*d* is pivoted toward the fixed base 8, a repulsive force in the twisting direction is generated in the torsion shaft portion 23*c*, and this repulsive force biases the free end portion 23*e* toward the outer peripheral surface of the check cam 20.

Since a pair of flanges 22*a* are formed at opposite ends of the roller 22, and arranged so as to sandwich the check cam 20 from opposite sides thereof, the roller 22 is prevented from dropping off the free end portion 23*e*.

The operation of this embodiment is now explained.

Opening and closing the door D allows the first and second hinge arms 1 and 2 to pivot relative to each other around the hinge pin 3 and, accompanying this, each time the roller 22 rolls on the outer peripheral surface of the check cam 20 with a set loading of the torsion spring 23 and engages with the detent notches 25*a* and 25*b*, the limiting resistance to the pivotal movement of the door D is generated. When the roller 22 is engaged with each of the detent notches 25*a* and 25*b*, releasing the opening/closing force exerted on the door D enables the door D to be held at that position due to the above resistance.

When the door D is being closed, after the roller 22 goes past the middle detent notch 25*b*, it goes down the angled surface 29 of the check cam 20 with the set loading of the torsion spring 23, thus giving a closing force to the door D.

When assembling the checker-equipped door hinge H, the fixed end portion 23*a* and the torsion shaft portion 23*c* of the torsion spring 23 are first respectively engaged with one of the second notches 33 of the second hinge arm 2 and the bush 34 fitted into the first notches 32, the free end portion 23*e* supporting the roller 22 is pressed toward the fixed base 8 of the second hinge arm 2, and the free end portion 23*e* is fixed to the second hinge arm 2 by means of an appropriate jig in a state in which a torsional load is exerted on the torsion shaft portion 23*c*.

The inner arms 9 of the second hinge arm 2 are then inserted between the outer arms 6 of the first hinge arm 1, and both the arms 6 and the arms 9 are connected together with the hinge pin 3. Detaching the jig from the second hinge arm 2 allows the roller 22 to be pressed against the outer peripheral surface of the check arm 20 due to the set loading of the torsion spring 23.

In this way, the torsion spring 23 can be mounted on the second hinge arm 2 by means of an extremely simple structure in which the first and second notches 32 and 33 are provided on opposite surfaces of the fixed base 8 of the second hinge arm 2, and the torsion shaft portion 23*c* and the fixed end portion 23*a* of the torsion spring 23 are engaged with the notches 32 and 33, so that a set loading in the twisting direction is exerted on the torsion shaft portion 23*c*. In particular, since it is extremely easy to machine the opposite surfaces of the fixed base 8 of the second hinge arm 2 to form the first and second notches 32 and 33, and to engage the torsion shaft portion 23*c* and the fixed end portion 23*a* with the first and second notches 32 and 33, the workability and the assemblability are very good, thus contributing to a reduction in the cost.

Moreover, by fixedly attaching the fixed base 8 to the body B, the openings of the second notches 33, with one of which the fixed end portion 23*a* of the torsion spring 23 is engaged, are blocked by the body B, and it is therefore possible to prevent the fixed end portion 23*a* from falling out of the second notches 33 without employing any special blocking member, thereby further simplifying the structure.

Furthermore, since the check cam 20 is formed separately from the first hinge arm 1, a plurality of types of checker-equipped door hinges H having various check properties can be obtained by preparing a plurality of types of the check cams 20 having various peripheral shapes because of the positions and number of the detent notches 25*a* and 25*b* and fixedly attaching these check cams 20 to the first hinge arms 1 having identical structures. Therefore, because it is only the shape of the small check cam component is changed according to the requirement of the check properties, and because the comparatively large-sized first hinge arm is used in common for door hinges equipped with various types of checkers, it is possible to mass-produce the first hinge arm, so that the cost of the various types of checker-equipped door hinges can be greatly reduced.

Moreover, since the check cam 20 and the first hinge arm 1 are made separately from each other, it is possible to use materials according to their respective functions. In particular, since the check cam 20 is molded using a sintered metal, its comparatively complicated shape can be molded easily with high precision and, moreover, it is possible to impart oil-bearing properties to the check cam 20, thereby preventing noise when the roller 22 rolls.

Furthermore, since the mounting flange 26 is provided integrally with one of the outer arms 6 of the first hinge arm 1 via the positioning step 27, the mounting flange being spaced from the inner arm 9, of the second hinge arm 2, that is adjacent to said one of the outer arms 6, and the check cam 20 is engaged with the positioning step 27 and riveted to the mounting flange 26, it is possible to improve the mounting precision of the check cam 20, and to improve the appearance by concealing the inner peripheral end of the check cam 20 with the mounting flange 26.

Moreover, since the roller 22 is rotatably fitted around the free end portion 23*e* of the torsion spring 23 and supported thereby, the torsion spring 23 serves also as a support arm for the roller 22, thereby contributing to a simplification of the structure.

The present invention is not limited by the above-mentioned embodiment and can be modified in a variety of ways without departing from the spirit and scope thereof. For example, the first hinge arm 1 and the second hinge arm 2 can be fixedly attached to the door D and the body B respectively. The check cam 20 may be fixed by welding to the mounting flange 26. Moreover, the number and the positions of the detent notches 25*a* and 25*b* formed in the check cam 20 can be freely selected.

What is claimed is:

1. A checker-equipped door hinge comprising a first hinge arm fixedly attached to one of a body and a door, a second hinge arm fixedly attached to the other one of the body and the door, a hinge pin connecting the first and second hinge arms in a relatively pivotable manner, and a checker formed separate from and disposed between the first and second hinge arms, wherein the checker includes a check cam that has a plurality of detent notches and is attached to the first hinge arm, a roller that can sequentially engage with the plurality of detent notches in response to the pivoting of the first and second hinge arms relative to each other, and a check spring that is mounted in the second hinge arm and biases the roller in a direction in which the roller engages with the detent notches, wherein the second hinge arm has a first notch provided on the front surface of a fixed base fixedly attached to said other one of the body and the door, the first notch being parallel to the hinge pin, and has a second notch provided on the reverse surface of the fixed base at a position spaced from the first notch toward the side opposite to the hinge pin, the check spring is formed from a single length of spring wire rod so as to have a torsion shaft portion supported in the first notch, a fixed end portion supported in the second notch, a free end portion rotatably supporting the roller, a U-shaped fixed arm portion providing a connection between the fixed end portion and one end of the torsion shaft portion, and a U-shaped movable arm portion providing a connection between the other end of the torsion shaft portion and the free end portion, and a set loading is applied to the torsion shaft portion in a twisting direction such that the free end portion is biased toward the detent notch side.

2. The checker-equipped door hinge according to claim 1, wherein the opening of the second notch is blocked by said other one of the body and the door to which the fixed base is fixedly attached.

* * * * *